US009147938B2

(12) United States Patent
Hallivuori

(10) Patent No.: US 9,147,938 B2
(45) Date of Patent: Sep. 29, 2015

(54) LOW FREQUENCY DIFFERENTIAL MOBILE ANTENNA

(75) Inventor: Juha Samuel Hallivuori, Tempere (FI)

(73) Assignee: Nokia Technologies Oy, Espoo (FI)

( * ) Notice: Subject to any disclaimer, the term of this patent is extended or adjusted under 35 U.S.C. 154(b) by 413 days.

(21) Appl. No.: 13/554,058

(22) Filed: Jul. 20, 2012

(65) Prior Publication Data

US 2014/0022136 A1 Jan. 23, 2014

(51) Int. Cl.

| | |
|---|---|
| ***H01Q 9/26*** | (2006.01) |
| ***H01Q 7/00*** | (2006.01) |
| ***H01Q 1/48*** | (2006.01) |
| ***H01Q 9/42*** | (2006.01) |

(52) U.S. Cl.
CPC . *H01Q 7/00* (2013.01); *H01Q 1/48* (2013.01); *H01Q 9/26* (2013.01); *H01Q 9/42* (2013.01)

(58) Field of Classification Search
CPC ..... H01Q 1/48; H01Q 9/26; H01Q 7/00; H01Q 9/42
See application file for complete search history.

(56) References Cited

U.S. PATENT DOCUMENTS

| | | | | |
|---|---|---|---|---|
| 6,836,249 | B2 * | 12/2004 | Kenoun et al. | 343/700 MS |
| 7,123,209 | B1 * | 10/2006 | Desclos et al. | 343/860 |
| 7,671,804 | B2 * | 3/2010 | Zhang et al. | 343/700 MS |
| 7,796,090 | B2 | 9/2010 | Minad et al. | |
| 7,911,405 | B2 | 3/2011 | Pascolini et al. | |
| 8,610,638 | B2 * | 12/2013 | Larsen et al. | 343/866 |
| 2003/0103010 | A1 * | 6/2003 | Boyle | 343/702 |
| 2003/0234744 | A1 * | 12/2003 | Podger | 343/742 |
| 2005/0280587 | A1 * | 12/2005 | Svigelj et al. | 343/702 |
| 2006/0055618 | A1 * | 3/2006 | Poilasne et al. | 343/866 |
| 2008/0007457 | A1 * | 1/2008 | Copeland et al. | 343/700 MS |
| 2009/0121947 | A1 * | 5/2009 | Nysen | 343/702 |
| 2010/0277383 | A1 * | 11/2010 | Autti et al. | 343/749 |
| 2011/0109515 | A1 * | 5/2011 | Rao | 343/702 |
| 2012/0133571 | A1 * | 5/2012 | Collins et al. | 343/860 |

FOREIGN PATENT DOCUMENTS

| | | | |
|---|---|---|---|
| GB | 2 427 760 | A | 1/2007 |
| WO | WO 01/52353 | A1 | 7/2001 |
| WO | WO 02/05384 | A1 | 1/2002 |

(Continued)

OTHER PUBLICATIONS

Smith, et al., "Antenna Engineering Handbook", Second Edition, Chapter 5, Loop Antennas, (pp. 1-4 and 5-1 through 525).
Constantine A. Belanis, "Antenna Theory Analysis and Design", Section 1.4 entitled, "Current Distribution on a Thin Wire Antenna", (ISBM 0-471-60639-1), (pp. 11-16), (May 3, 1969).

(Continued)

*Primary Examiner* — Trinh Dinh
(74) *Attorney, Agent, or Firm* — Harrington & Smith

(57) ABSTRACT

An antenna which is advantageous for low frequency communications and suitable for use in a portable electronic device comprises an antenna resonator element and a grounding line. The resonator element is configured to resonate at a frequency f, and comprises a first port and a second port that are configured to be differentially fed. The grounding line couples a virtual node of the resonator element to ground, where the virtual node defines a negligible current when the resonator element is resonant at the frequency f. In the specific examples the antenna could be a folded monopole, a folded dipole, a loop, or other type of differential antennas. Radiation efficiency is quantified for a long folded monopole implementation which shows a marked improvement over an identical antenna without such a grounding line, particularly when used with a radio receiver.

20 Claims, 12 Drawing Sheets

(56) References Cited

FOREIGN PATENT DOCUMENTS

| | | | |
|---|---|---|---|
| WO | WO 2005/018045 | A1 | 2/2005 |
| WO | WO 2008/037200 | A1 | 4/2008 |

OTHER PUBLICATIONS

Shamim et al., "Silicon Differential Antenna/Inductor for Short Range Wireless Communication Applications", Department of Electronics, (May 2006), (pp. 94-97).

* cited by examiner

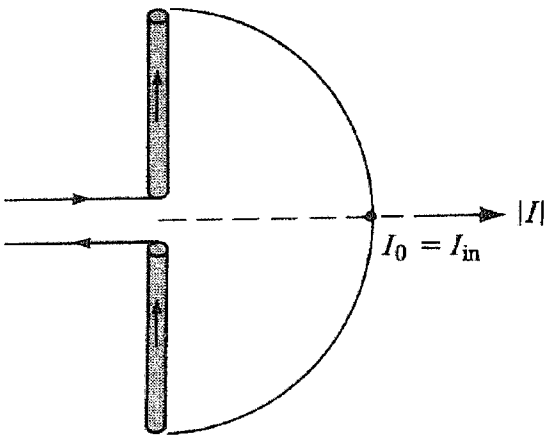
(b) $l = \lambda/2$
FIGURE 1B: Prior Art
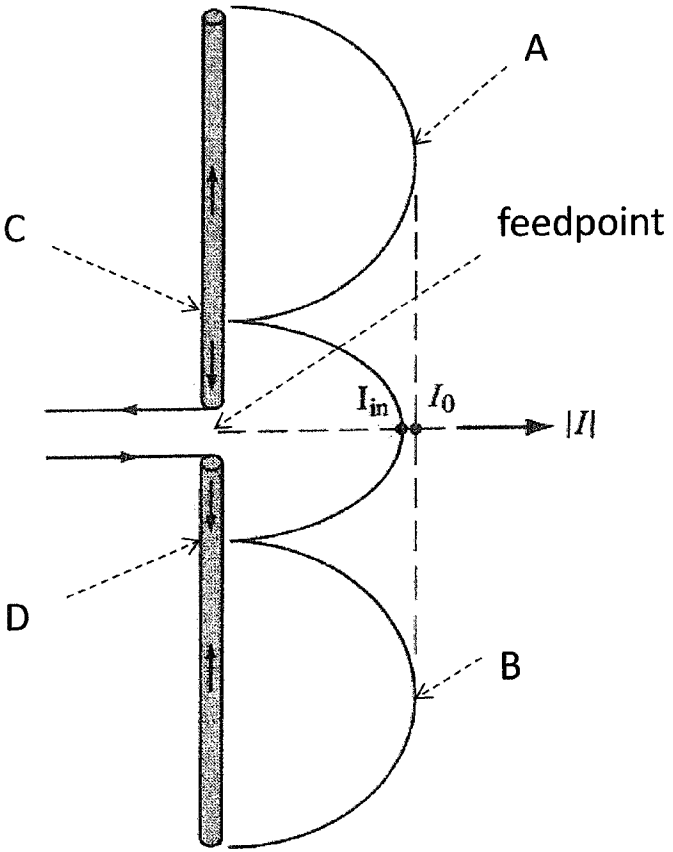
(d) $\lambda < l < 3\lambda/2$
FIGURE 1A: Prior Art

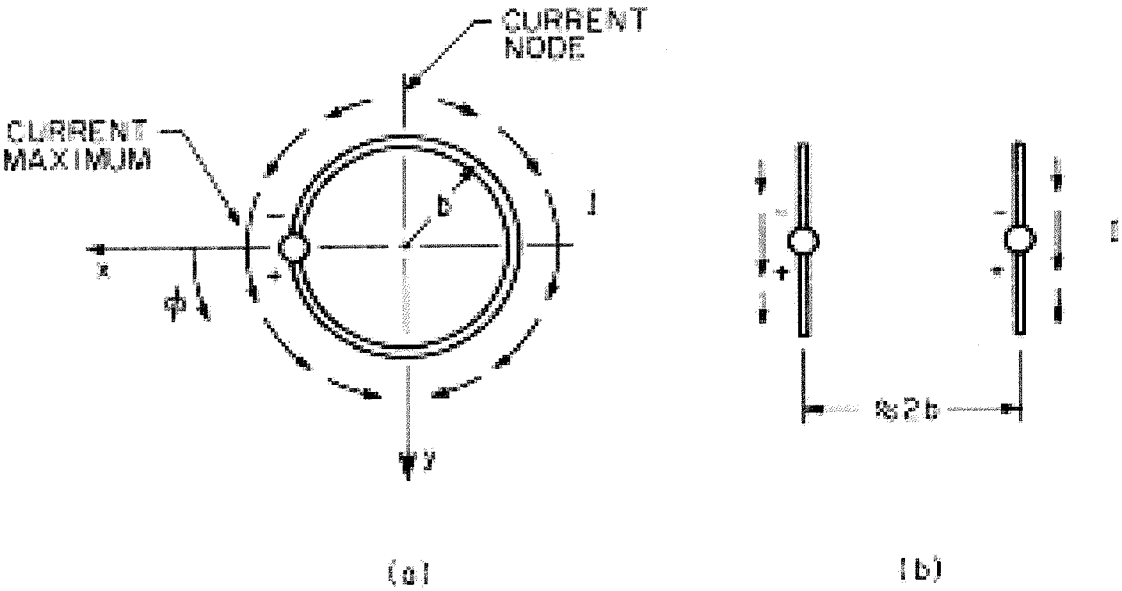
FIGURE 1C: Prior Art

FIG.7
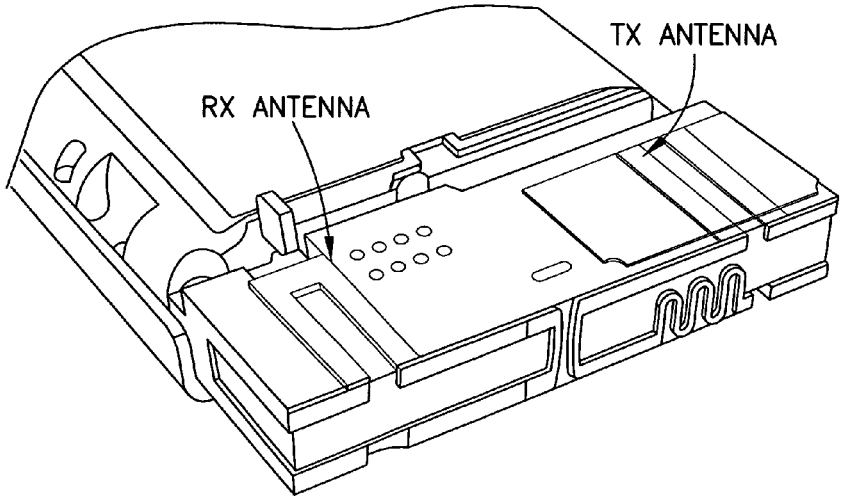
MEASURED PROTOTYPE
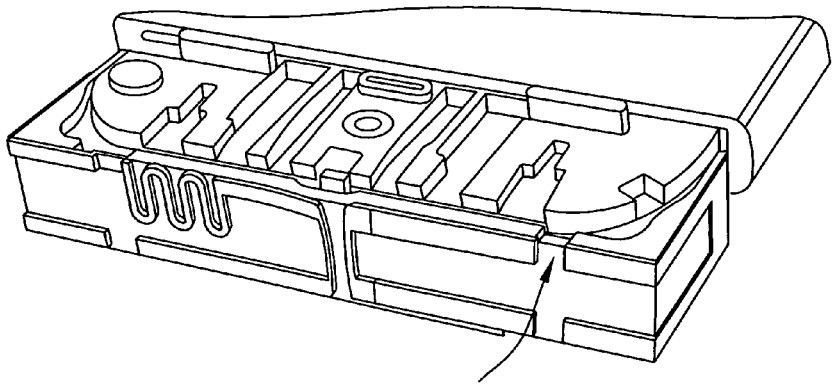
GROUND LENGTHENING WIRE IS CONNECTED HERE
WIRE IS PLACED OVER THE PCB (FREE OF GND AREA)

LOW FREQUENCY DIFFERENTIAL MOBILE ANTENNA

TECHNICAL FIELD

The example and non-limiting embodiments of this invention relate generally to antennas for wireless communications including methods and devices therefore, and more specifically relate to antenna radiator elements suitable for low frequency communications (e.g., 700-900 MHz).

BACKGROUND

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

In a field of antenna technology a low frequency differential antenna has been difficult to realize in practice. For low frequency single ended (unbalanced) antennas, the ground plane is the main radiator and currents are induced in it by the antenna wire which acts as an excitation element, so below 1 GHz the size of the ground plane has a large effect on performance of an unbalanced antenna. But in an idealized low frequency differential (balanced) antenna the current flows only in the wire/resonating element and not in the ground plane so the size of the radiating element becomes more important to the antenna performance. For a truly balanced 900 MHz antenna the radiating element would be quite large. Because modern consumer electronics such as mobile terminals are very constrained in size, there is a desire to find an alternative arrangement for a balanced antenna that has efficient performance in both the low and high frequency bands and which is small enough to integrate effectively with other close-packed electronics within a handheld device.

As radio spectrum becomes more scarce and the ability to pack multiple radios into a single handset continues to improve, the need for low frequency communications using a mobile user device is growing. Low frequencies in this context refers to frequencies below about 1000 MHz. While different regions and countries define their radio spectrum differently, in some areas the 900 MHz band is in the Industrial/Scientific/Medical ISM band or television whitespace TV WS bands (and thus is license-exempt spectrum), in others it was once used for the Global System for Mobile Communications GSM radio access technology, and it is also the band used by the ZigBee radio access technology. Generally low frequency refers to the lower half of the UHF band, roughly about 200 MHz to about 1000 MHz.

SUMMARY

In a first aspect the exemplary embodiments of the invention provide an apparatus comprising an antenna resonator element configured to resonate at a frequency f, where the resonator element comprises a first port and a second port which are configured to be differentially fed. The apparatus further comprises a grounding line coupling a virtual node of the resonator element to ground, in which the virtual node defines a negligible current when the resonator element is resonant at the frequency f. In the examples below advantages are quantified for the case where the frequency f is low, for example within the range 700 MHz to 1000 MHz.

In a second aspect the exemplary embodiments of the invention include a method comprising: providing an antenna resonator element that is configured to resonate at a frequency f, and which comprises a first port and a second port that are configured to be differentially fed. Further in the method a grounding line is operatively coupled between a virtual node of the resonator element and ground, where the virtual node defines a negligible current when the resonator element is resonant at the frequency f.

BRIEF DESCRIPTION OF THE DRAWINGS

FIGS. 1A-C are prior art drawings reproduced from other references noted herein and illustrate current distribution in different types of antenna resonator elements.

FIG. 7 illustrates a prototype mobile terminal including separate receive and transmit antennas as arranged for generating the data presented at FIG. 8.

DETAILED DESCRIPTION

Figure 2:
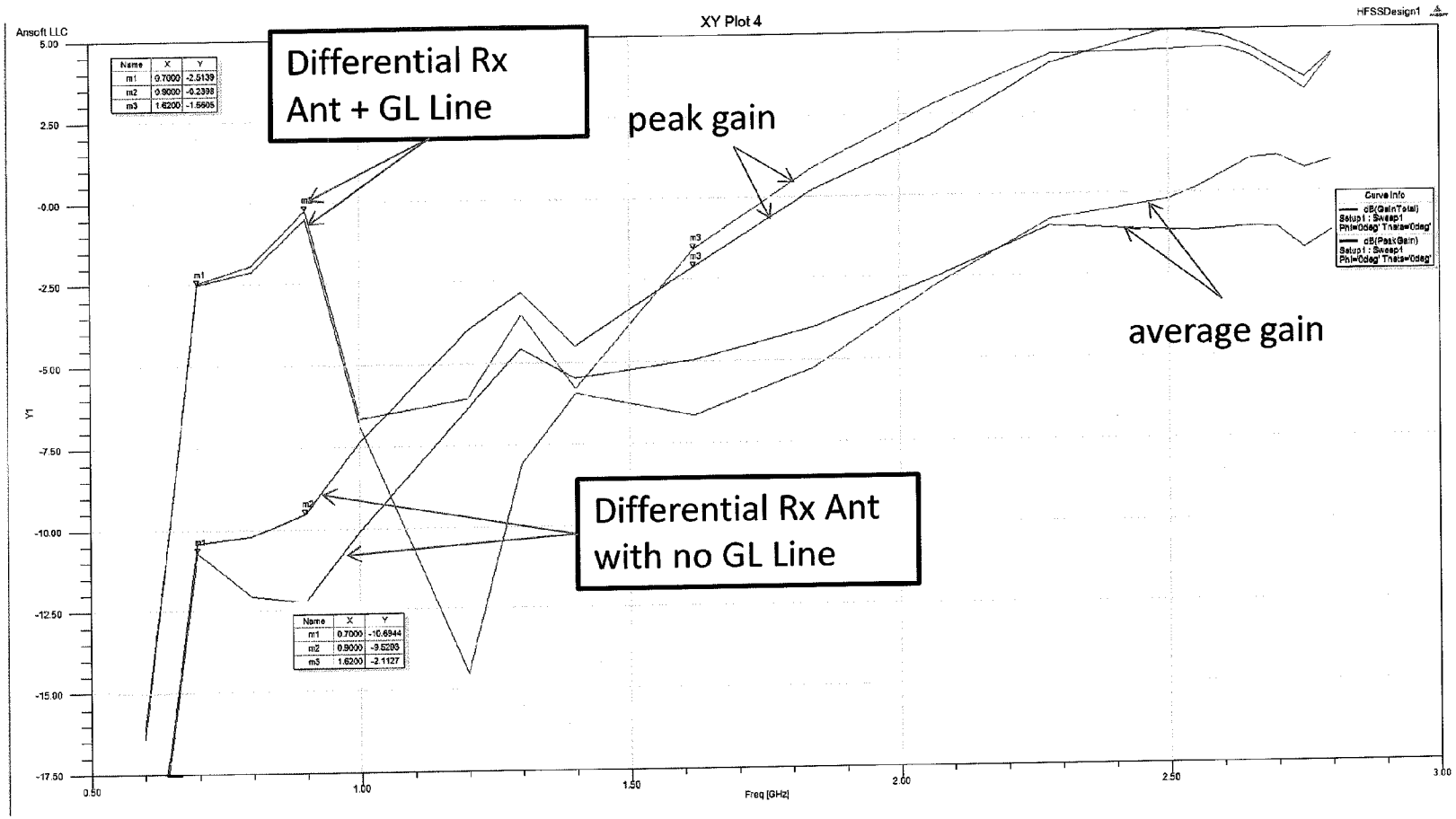
FIG. 2 is a plot of peak gain and total gain versus frequency showing quantitative improvement of an antenna embodying these teachings as compared to a similar antenna that does not.

Embodiments of these teachings generally relate to differential or balanced antennas, meaning antennas which have differentially fed first (+) and second (−) ports. Often balanced antennas will be fabricated to couple directly to integrated circuits (ICs) which have the same differential ports. Balanced antennas can also be coupled to 'single-ended' ports of an IC via a balun, which is a transformer that switches the ports from balanced to unbalanced (see for example co-owned U.S. Pat. Nos. 7,084,728 and 7,733,205). Single-ended or unbalanced ports typically have a radio frequency (RF) port and a ground port.

Balanced antennas can be of various types: loop antennas; dipoles, folded-monopoles; and folded-dipoles being a non-exhaustive list of examples. The mere presence of two ports or connections, as in a loop antenna for example, does not necessarily make an antenna a balanced one. For example, if one of these ports is coupled to ground then the antenna would be a single-ended antenna despite that the loop structure may make it appear to be a balanced antenna. A single-ended radiating element may only have a radio frequency port, for example, a monopole radiating element couples only to a RF port, and not to a second port. In the case of a monopole the ground plane acts as a counter-poise to the monopole radiating element and is not coupled to the ground plane galvanically. Examples of single-ended antenna radiating elements are monopoles, inverted-F antennas (IFAs), planar inverted-F antennas (PIFAs), and helical or helix antennas, as a non-exhaustive list.

To fully understand these teachings it is important to understand current distribution within the antenna resonator element. Reference in this regard can be seen in the textbook Antenna Theory Analysis and Design by Constantine A. Belanis (ISBM 0-471-60639-1), particularly section 1.4 entitled Current Distribution on a Thin Wire Antenna. FIG. 1A reproduces FIG. 1.12(d) from that reference and shows a center fed dipole antenna with the length l between the dipole ends being greater than the resonant wavelength $\lambda$ and less than $3\lambda/2$. The current distribution is sinusoidal, with maximum current at points A and B (as well as at the dipole feedpoint where the current has opposite phases where the dipole arms first diverge) and minimum current at points C and D where current is effectively zero (those points are herein added to the original drawing). It can be seen that current is also effectively zero at the dipole ends. An antenna with the current distribution shown at FIG. 1 for a given $\lambda$ will have the maximum and minimum current nodes at different locations for a different wavelength.

The null-current points C and D shown at FIG. 1A might be considered as virtual nodes, for they are not physically fixed and can be identified by applying a frequency signal to the antenna resonator. As noted above the location of those nodes depends on the frequency f; in simple form a constant waveform velocity $c=\lambda f$ (where $c=3\times10^8$ meters/second) and so a standing wave on an antenna resonator has frequency $f=c/\lambda$. It follows that the location of the current maximum and minimum for a balanced antenna is also dependent on the layout of the antenna resonator and its physical dimensions (electrical length). It should also be understood that antenna resonator elements may be physically short with respect to a factor of a wavelength meaning that the antenna resonator element may have an electrical length that is too small and thus requires "lengthening" using lumped (components) or distributed (microstrip, stripline, co-planar waveguide, etc) radio frequency reactive elements (inductors and/or capacitors) in series with the radio frequency feed, this may also be called "reactive loading". In this case at certain frequencies the virtual current nodes may not be located along the physical antenna resonator element as expected due to the additional reactive loading applied.

Further background concerning current distribution in loop antennas can be seen at the textbook Antenna Engineering Handbook, 2nd Edition (edited by Richard C. Johnson and Henry Jasik; McGraw Hill Book Company) and particularly at Chapter 5: Loop Antennas by Glenn S. Smith. In general those skilled in the antenna arts are well versed in current distribution in resonator elements of various types of antennas. In microelectronics such as a mobile handset, laptop computers and the like the resonant portion of antennas which transmit frequency signals into the air and receive frequency signals from the air are often embodied as a conductive (or metallic) trace or pattern of conductive material or metallization. Whether macro-sized or minimalist as in a trace or pattern, these elements of the antenna are termed more generally herein as the resonator element or resonator.

Having reviewed balanced antennas and current distribution, embodiments of these teachings provide that the resonator element of a balanced antenna is coupled to ground at one or more virtual current node which exhibits effectively zero current. Such a virtual current node is shown at FIG. 1A as nodes C and D (as well as the feedpoint). This coupling to ground may be considered as a 'ground lengthening' line (GL line) because it does not affect the 'balanced' nature of the antenna. For manufacture, for a given antenna type the virtual current node or nodes will need to be found and a coupling point added there to attach the GL line. As will be quantified below, a GL line disposed at a zero current virtual node of a balanced antenna resonator can significantly improve that antenna's performance in the low band, about 900 MHz (typically considered as about 700-1000 MHz but more generally in the band 200-1000 MHz).

As was noted above, current distributions change in the same antenna type in dependence on the electrical length of the antenna. So for example a quarter wavelength dipole has a different current distribution than a half wavelength dipole. For a half wavelength dipole having two feed ports, the current distribution would have only one current maximum at the feed ports and there would be two current minimas, one at the end of the first element or "arm" and the second would be at the end of the second element or "arm". This is shown at FIG. 1B, reproduced from FIG. 1.13(b) of the textbook Antenna Theory Analysis and Design by Constantine A. Belanis (cited above).

In contrast, for a dipole which is at least one wavelength long there would be three current maxima and four current minima. The current maxima would be at the feed ports and then roughly half way along the length of each dipole arm. The current minima would be at both dipole ends and also between the feed ports and the current maxima which is located between the end of each dipole arm and the feed port.

For a loop antenna the current maximum (voltage minimum) would be at the feed point ($\phi=0$ radians), which is where the two feed ports of the loop antenna resonator couple to the radio circuitry. If the loop circumference is equal to one wavelength then there would be a further or second current maximum at 180 degrees from the feed point, at the half way point (or $\phi=\pi$ radians). For this resonator element there would also be a current minimum or virtual null-current node (voltage minimum) at $\phi=\pi/2$ radians and another virtual null-current node at $\phi=3\pi/2$ radians. This is shown at FIG. 1C, reproduced from FIG. 5-14 of Chapter 5: Loop Antennas from the textbook Antenna Engineering Handbook, 2d Edition (cited above).

Note that folded monopoles and dipoles are different types of differential antennas from the differential loop antenna resonator noted above, and so those types will have still different current distributions.

Ground lengthening at the virtual node of the differential antenna enhances gain at the lower frequencies as compared to the same antenna without the ground lengthening line. This is quantified at FIG. 2 for both peak gain (one direction through the 3-dimensional gain pattern sphere) and total gain (averaged over the sphere). FIG. 2 shows that gain is maximized at 900 MHz before dropping off sharply until 1.2 GHz where it rises again. The plot lines are labeled and from FIG. 2 it can be seen that for reception the ground lengthening line according to these teachings achieves a significant gain improvement over the same balanced receive antenna without such a ground lengthening line.

Figure 3:
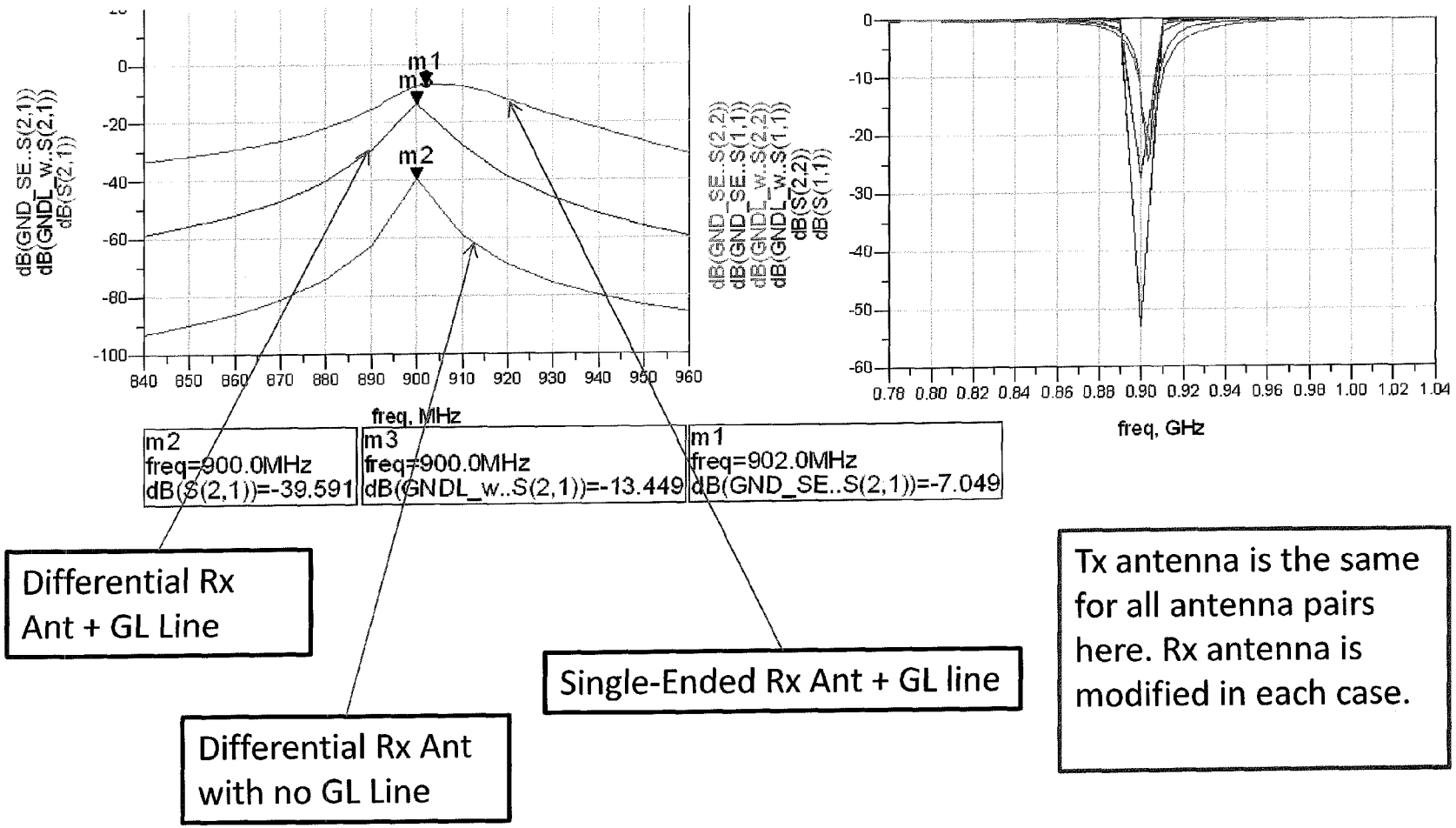
FIG. 3 are plots of gain versus frequency and show isolation between a differential transmit and receive antenna and a single ended antenna embodying these teachings as compared to similar antennas that do not.

FIG. 3 illustrates isolation between separate transmit (TX) and receive (RX) antennas in the case of perfect complex conjugate matching. There is a marked improvement over a prior art differential RX antenna without a ground lengthening line by that same antenna with a ground lengthening line. For further comparison FIG. 3 also illustrates isolation by a single-ended receive antenna with a ground lengthening line at a null-current node.

Figure 4:
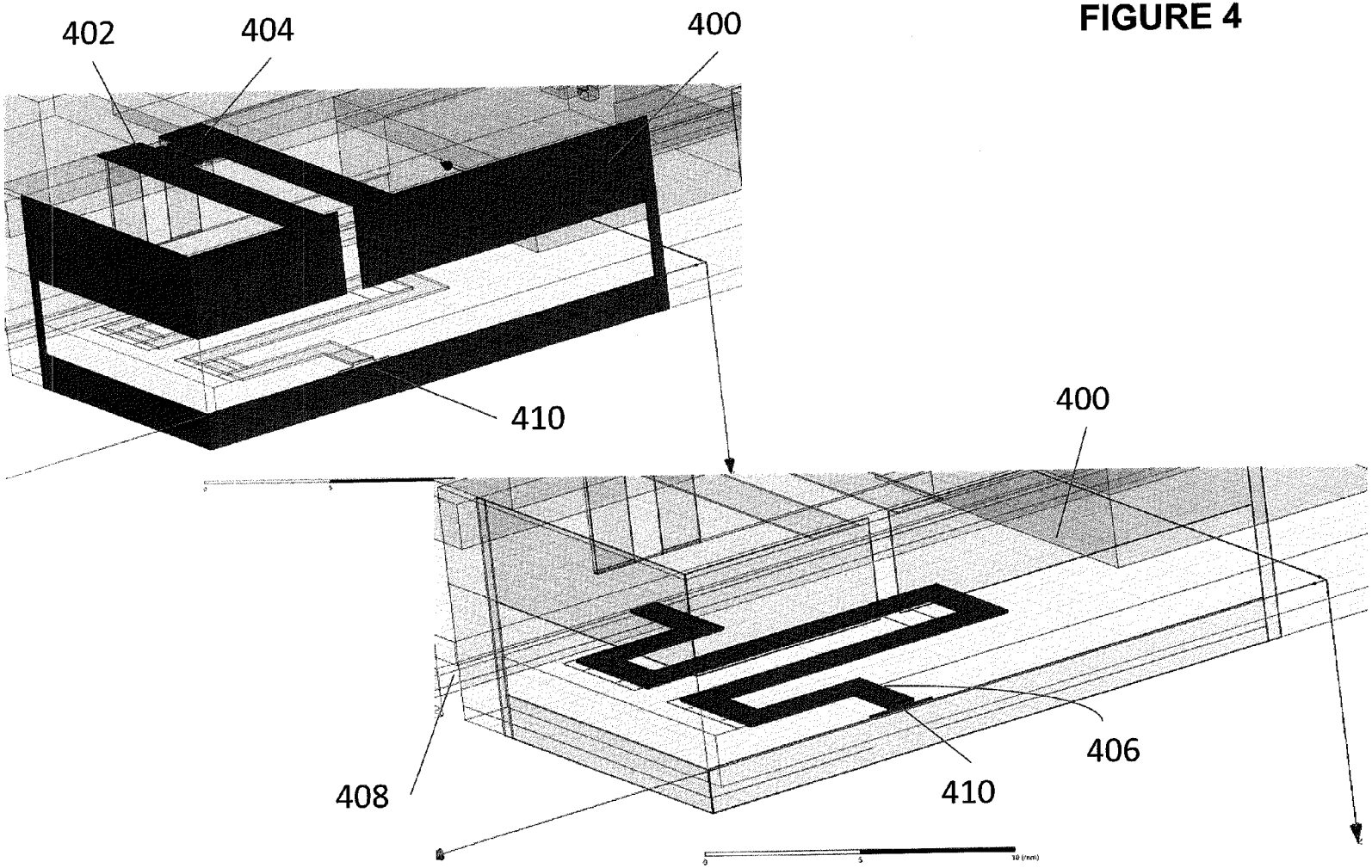
FIG. 4 is a perspective rendition of a differential folded monopole antenna which embodies these teachings disposed within a housing of a mobile terminal, in which the lower section of the Figure emphasizes the ground lengthening line galvanically coupled to the folded monopole resonator element of the antenna at a virtual ground node.

FIG. 4 shows a perspective rendition of a differential monopole antenna disposed within a mobile terminal. A (long) balanced monopole was chosen so that the virtual null-current node can be more easily detected. The upper section of this Figure emphasizes the monopole resonator 400 and shows its two terminals/ports 402, 404 for coupling to the RF IC or other radio frequency circuitry. The lower section of this Figure emphasizes the ground lengthening line 406 galvanically coupling the ground plane 408 to the monopole resonator element 400 of the antenna at a virtual ground node 410. These same reference numbers are continued throughout the remaining Figures. In other embodiments the ground lengthening can be implemented on a printed wired board, for example under the carrier of the antenna trace. The ground plane 408 may be provided by one or more methods as known in the art, for example and not limited to: one or more layers of a printed wiring board or printed circuit board, one or more layers of a flexible printed wiring board or flex circuit, a conductive sheet material, a conductive solid material, sprayed or sputtered conductive material onto a non-conductive part, laser direct structured (LDS) conductive parts, molded interconnect device (MID) conductive parts, a conductive object, component or part of the mobile terminal, or any combination of the above.

Figure 5:
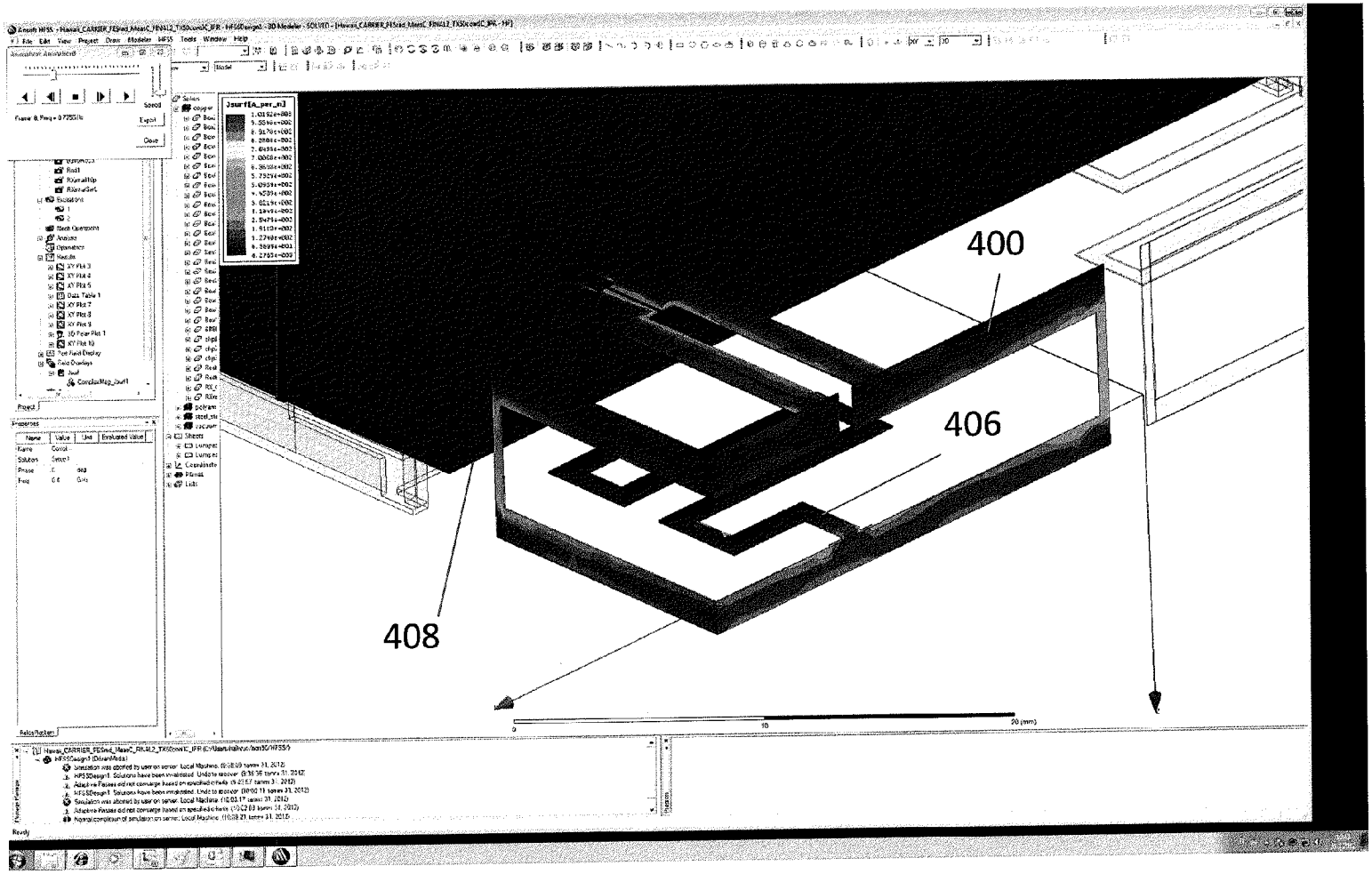
FIG. 5 illustrates the result of high frequency structure simulator HFSS simulations showing surface currents in the embodiment of FIG. 4 with ground lengthening at 775 MHz.
Figure 6:
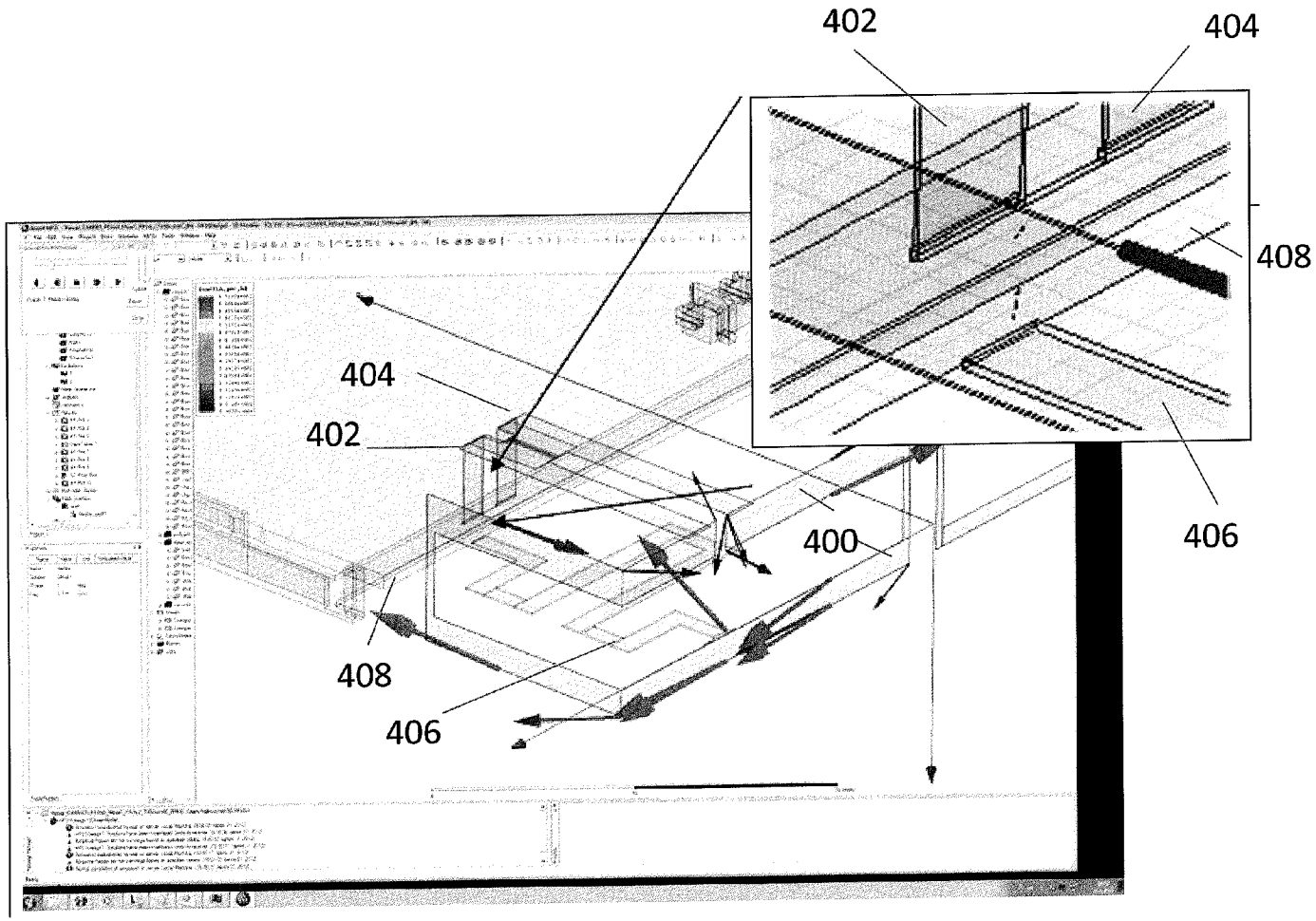
FIG. 6 illustrates the same data as FIG. 5 but showing surface currents as vectors, and showing ground currents at the inset.

FIG. 5 illustrates the same embodiment as FIG. 4 but also illustrates surface currents in the resonator element with ground lengthening and with a 775 MHz signal applied to the resonator 400. These surface current results were obtained using high frequency structure simulator HFSS simulations. FIG. 6 illustrates similarly as FIG. 5 except the surface current data is shown as vectors. The inset of FIG. 6 expands the area where the ground lengthening line 406 contacts the ground plane 408 to show that essentially zero current is flowing to ground despite the resonator element 400 being active at 775 MHz.

FIG. 7 illustrates a prototype mobile terminal similar to that shown at FIG. 4, except FIG. 7 additionally includes a separate transmit antenna at an opposed corner of the mobile terminal. The left side of FIG. 7 is from the same perspective as FIG. 4 while the right side shows the prototype mobile terminal having been inverted to better illustrate the connection of the ground lengthening wire to the monopole resonator. The prototype shown as FIG. 7 was used to generate the test data of FIG. 8.

Figure 8:
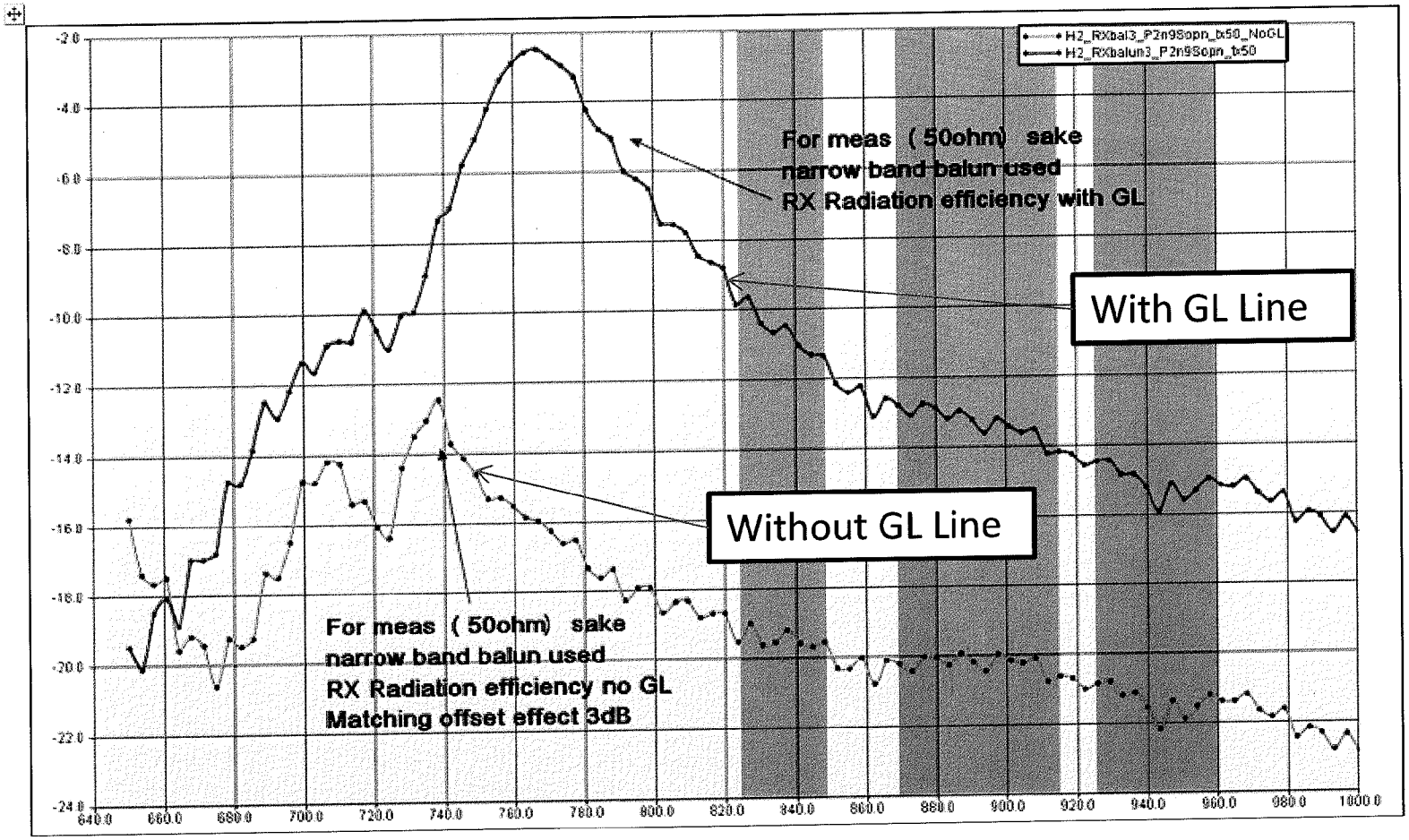
FIG. 8 is a plot of gain versus frequency and showing radiation efficiency for the antenna disposed in the prototype of FIG. 7 as compared to a similar antenna without the ground lengthening detailed herein.

FIG. 8 is a plot of gain (radiated efficiency) versus frequency and quantifies total efficiency of the antenna shown at the FIG. 7 prototype in comparison to a similar antenna without the ground lengthening line shown at FIG. 7. The differential antenna with the ground lengthening line is also shown more clearly in the schematic renditions of FIGS. 4-6. For this test data, the prototype of FIG. 7 used a narrow band balun at the input of the receive antenna for measuring purposes, to have the possibility for a 1-port efficiency measurement. The transmit side was grounded with a 50 ohm resistance. The impedance matching S11 measurements (not illustrated) were less than −15 dB. Due to the balun the impedance was affected and so the comparative plot shown at FIG. 8 is not an exact comparison; the effect of that mis-match is about 3 dB and FIG. 8 notes that offset in the explanatory text.

Figure 9:
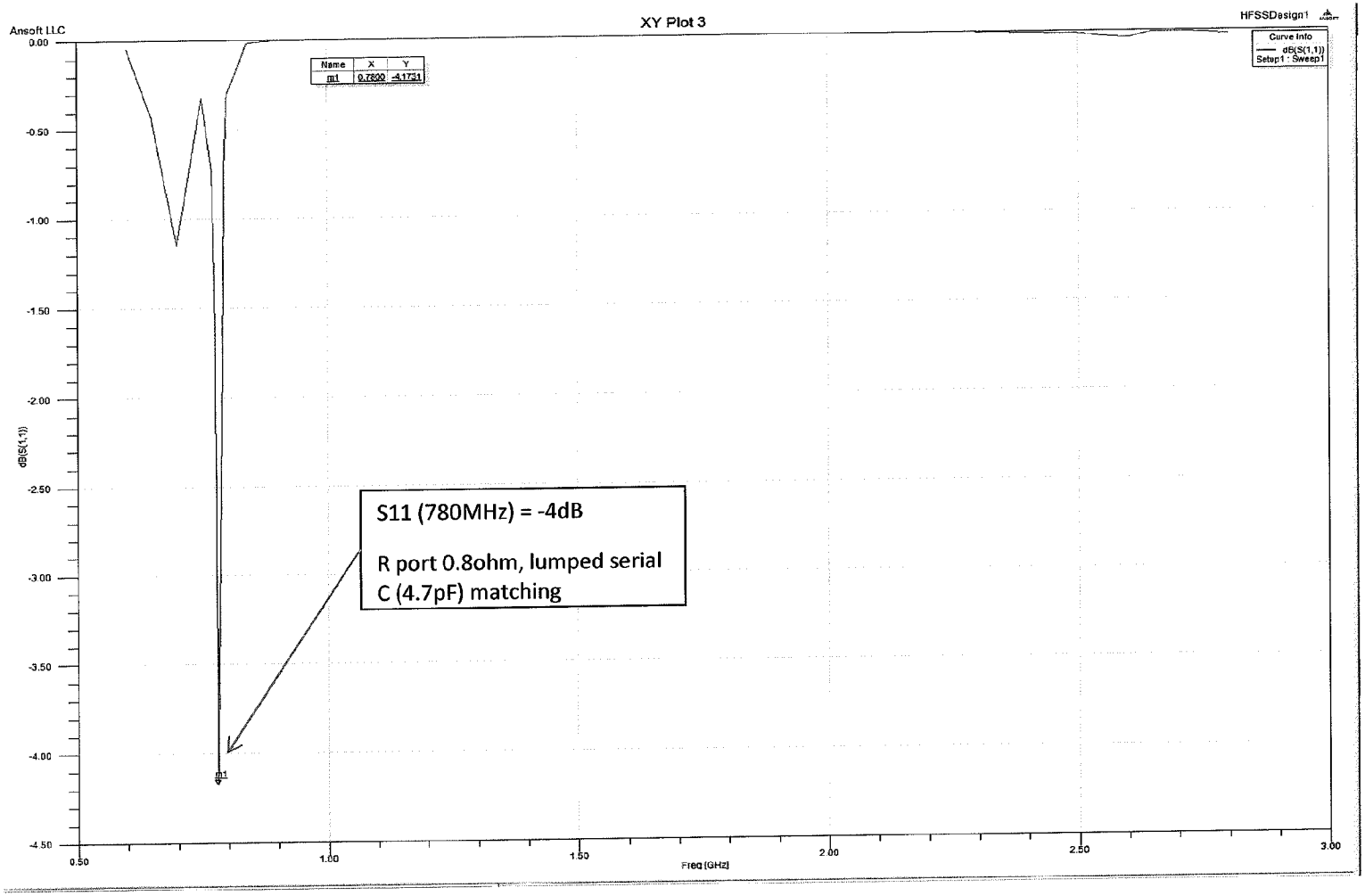
FIG. 9 is a plot of simulated return loss (or S11) in dB versus frequency for a receive antenna embodying these teachings and showing impedance matching (return loss) information.

FIG. 9 is a plot of simulated return loss (or S11) in dB versus frequency for a receive antenna embodying these teachings and showing impedance matching (return loss) and details of the matching components that were used.

Figure 10:
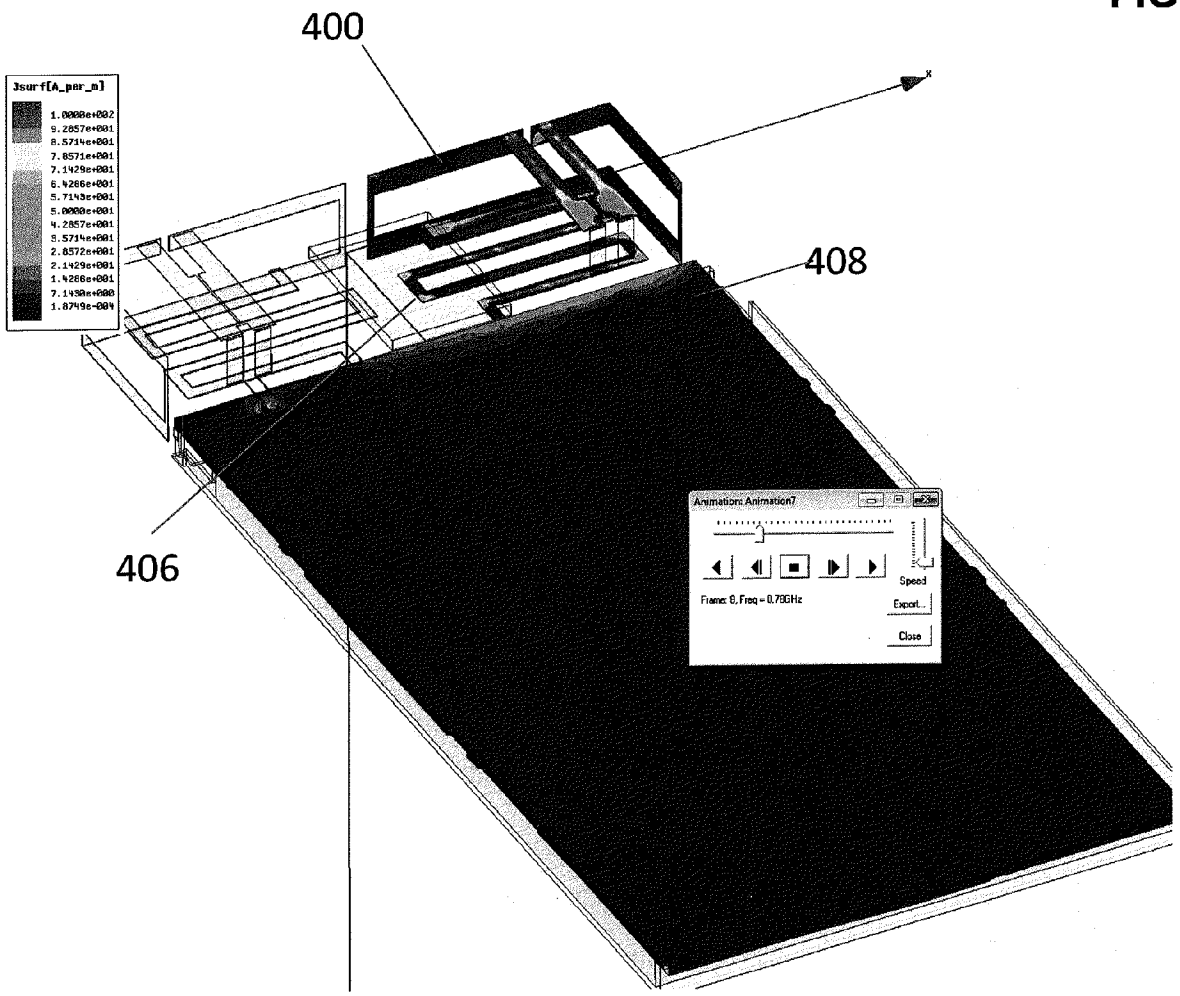
FIG. 10 illustrates the antenna shown at FIG. 5 from a different perspective and shows surface current on the antenna resonator element and its ground plane when receiving at 780 MHz.
Figure 11:
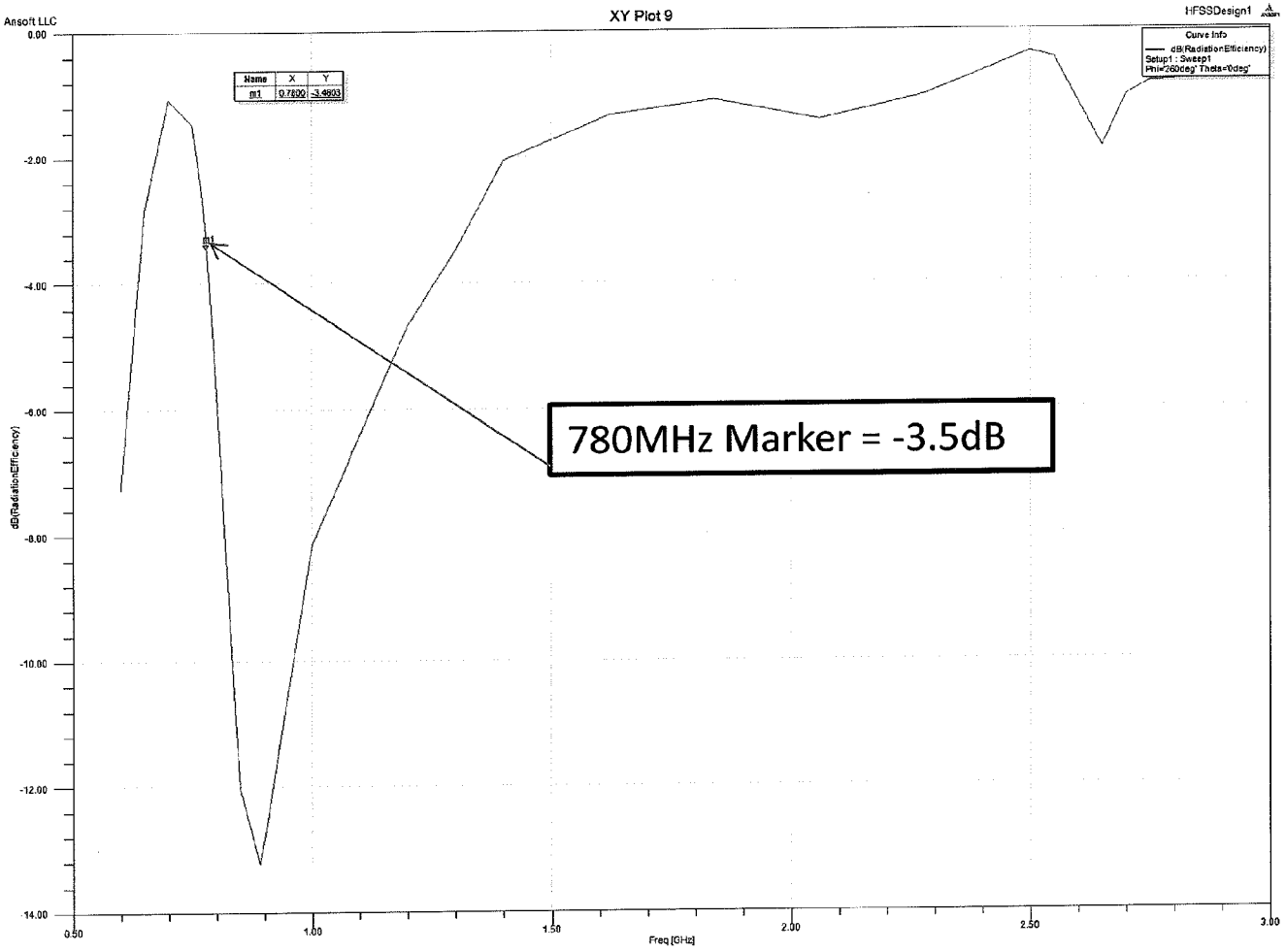
FIG. 11 is a plot of gain (radiation efficiency) versus frequency and showing the radiation efficiency of the antenna presented at FIG. 10.

FIG. 10 illustrates the antenna shown at FIG. 4 from a different perspective and shows surface current on the antenna resonator element 400 and its ground plane 408 when receiving at 780 MHz. FIG. 11 is a plot of gain (radiated efficiency) versus frequency and illustrates the efficiency of the FIG. 10 antenna arrangement.

Exemplary embodiments of these teachings provide certain technical effects. For example, low band performance is notoriously difficult to achieve for a balanced antenna in a small portable device without such a ground lengthening line. Low band in this respect refers to frequencies in the range of around 900 MHz (typically considered as about 700-1000 MHz, but more generally low band is the 200-1000 MHz end of the UHF band) in a portable electronic device. The above quantitative comparison at FIGS. 1-2 shows a 10 dB gain improvement over a similar antenna without the ground lengthening line detailed herein, while still maintaining a respectable isolation figure of −13 dB. Additionally, implementing such a ground lengthening line is not difficult during the manufacturing stage; for example it can be made into a support block or as a separate conductive line or track on the associated printed wiring board (PWB).

Additionally, locating two such balanced antennas next to one another does not pose a difficulty for antenna gain as compared to having two antennas where only one has a ground lengthening line as detailed herein. For a receive and transmit antenna pair in which only the receive antenna has the ground lengthening line, the receive antenna with the GL line exhibits a 10 dB gain improvement over a receive antenna which does not have such a GL line.

In the above examples the grounding line coupled the ground plane to a virtual node of zero current. This is the ideal but advantages can be gained also where the ground lengthening line is coupled to a portion of the resonator element at which there a minimum current magnitude ($\|I\|$) of the single balanced antenna element. As noted above, two or more such antennas can be co-located (adjacent), and the advantages detailed herein can be realized if one resonator having the ground lengthening line interfaces to the low frequency radio receiver and the other, which may or may not have the ground lengthening line, interfaces to the low frequency transmitter. In this case the two resonators can co-exist by providing adequate isolation and the gain improvements quantified above still remain.

According to exemplary embodiments of these teachings then there is an apparatus comprising an antenna resonator element 400 that is configured to resonate at a frequency f, and the resonator element comprises a first port 402 and a second port 404 that are configured to be differentially fed. This is what makes it a differential (or balanced) antenna. The apparatus also includes a grounding line 406 coupling a virtual node 410 of the resonator element to ground 408, in which the virtual node defines a negligible current when the resonator element is resonant at the frequency f. Negligible current in this regard means at least a localized current minimum along the resonator element, and ideally a zero current virtual node.

As noted above, advantages are most pronounced when the frequency f is within the range 700 MHz to 1000 MHz. While the tested embodiment of the antenna resonator element was a folded monopole, in other implementations it may be a folded dipole or a loop-type antenna resonator. These are but non-limiting examples of balanced antenna types, and the GL line teachings herein may be implemented in any other type of differential antenna. The test results presented at FIG. 2 and even more particularly at FIG. 11 show that the tested antenna resonator element 400 is resonant at both low and high bands. In this case if one considers the above 700-1000 MHz frequency f as a first frequency $f_1$ then the antenna resonator element 400 is also resonant at a higher second frequency $f_2$ which by those Figures lies within the range of about 1500 MHz to 2500 MHz The salient point in plotting gain/radiation efficiency for both low and high frequency bands is that the high band performance of the differential antenna is not adversely affected by the ground lengthening line which is added to improve the low band performance.

According to another exemplary embodiment an antenna can be made according to these teachings by providing an antenna resonator element that is configured to resonate at a frequency f, and this antenna resonator element also comprises a first port and a second port that are configured to be differentially fed. Then a grounding line (ground lengthening line) is operatively coupled between a virtual node of the resonator element and ground. In this case the virtual node defines a negligible current when the resonator element is resonant at the frequency f.

If one considers the antenna resonator element 400 as comprising a first conductive portion disposed between the first and second ports 402 and 404, and the grounding line 406 as comprising a second conductive portion formed between a first point 410 of the first conductive portion 406 and the ground 408, then it is clear that in the example embodiment shown at least at FIG. 4 that this first point 410 is disposed along the first conductive portion 406 about halfway between the first and second ports 402, 404, and the first point 410 defines the virtual node of the resonator element 400. Also in this example the ground is provided by the ground plane 408.

One particularly advantageous implementation is to couple a radio frequency (RF) integrated circuit or other RF circuitry to the first port and to the second port. Such a radio frequency integrated circuit or RF circuitry can comprise at least one of a radio receiver and a radio transmitter interfacing to the first port and the second port. Such a compact arrangement is suitable for use in a portable electronic device, such as for example mobile terminals/cellular telephones, personal digital assistants having wireless communication capabilities, portable computers having wireless communication capabilities (laptop, palmtop, tablet, etc.), image capture devices such as digital cameras having wireless communication capabilities, gaming devices having wireless communication capabilities, music storage and playback appliances having wireless communication capabilities, Internet appliances permitting wireless Internet access and browsing, as well as portable units or terminals that incorporate combinations of such functions.

When embodied in such a host device it was noted above that there may be two instances of the same or similar resonators in such a device, one for the receive side and one for the transmit side where the ground lengthening line was optional for the transmit side resonator and the gain improvement can still be retained on the receive side resonator.

In the embodiments of this invention it should be understood that the words "couple" and "connect" mean that the features being connected or coupled are operationally connected or coupled, including any derivatives of these words. It should also be appreciated that the connection or coupling may be a physical galvanic coupling or connection, and/or an electromagnetic non-galvanic coupling or connection. It should also be appreciated that any number or combination of intervening components can exist (including no intervening components) between the features which are coupled or connected together.

Various modifications and adaptations to the foregoing example embodiments of this invention may become apparent to those skilled in the relevant arts in view of the foregoing description, when read in conjunction with the accompanying drawings. However, any and all modifications will still fall within the scope of the non-limiting and example embodiments of this invention.

Furthermore, some of the features of the various non-limiting and example embodiments of this invention may be used to advantage without the corresponding use of other features. As such, the foregoing description should be considered as merely illustrative of the principles, teachings and example embodiments of this invention, and not in limitation thereof.

I claim:

1. An apparatus comprising:

an antenna resonator element configured to resonate at a frequency (f), said antenna resonator element comprising a first port and a second port, said first port and said second port being configured to be differentially fed; and a grounding line configured to couple a virtual node of the antenna resonator element to ground, the virtual node being where current has a minimum value in the antenna resonant element when the antenna resonator element is resonant at the frequency (f).

2. The apparatus according to claim 1, wherein the antenna resonator element comprises a first conductive portion disposed between the first and second ports, and the grounding line comprises a second conductive portion formed between a first point of the first conductive portion and the ground, and wherein the first point is disposed along the first conductive portion between the first and second ports.

3. The apparatus according to claim 2, wherein the first point coincides with the virtual node of the antenna resonator element.

4. The apparatus according to claim 2, wherein the first point is halfway between the first and second ports of the first conductive portion.

5. The apparatus according to claim 1, wherein the grounding line is provided by a ground plane.

6. The apparatus according to claim 1, wherein the frequency (f) is within the range 700 MHz to 1000 MHz.

7. The apparatus according to claim 6, wherein the antenna resonator element is at least one of a folded monopole, a folded dipole, and a loop.

8. The apparatus according to claim 1, wherein the frequency (f) is a first frequency ($f_1$) and the antenna resonator element is further configured to resonate at a second frequency ($f_2$) that is higher than the first frequency ($f_1$).

9. The apparatus according to claim 8, wherein the first frequency ($f_1$) is within the range 700 MHz to 1000 MHz and the second frequency ($f_2$) is within the range 1500 MHz to 2500 MHz.

10. The apparatus according to claim 1, further comprising a radio frequency integrated circuit or radio frequency circuitry coupled to the first port and to the second port.

11. The apparatus according to claim 10, wherein the radio frequency integrated circuit or the radio frequency circuitry comprises at least one of a radio receiver and a radio transmitter interfacing to the first port and the second port.

12. The apparatus according to claim 1, wherein the apparatus is disposed within a portable electronic device.

13. The apparatus according to claim 12, wherein said portable electronic device comprises a radio receiver and a radio transmitter, and wherein said antenna resonator element is a first antenna resonator element, said first antenna resonator element being interfaced with said radio receiver, said portable electronic device further comprising a second antenna resonator element, said second antenna resonant element being interfaced with said radio transmitter, and wherein the first and second antenna resonator elements are disposed adjacent to one another within the portable electronic device.

14. A method comprising:

providing an antenna resonator element configured to resonate at a frequency (f), and said antenna resonator element comprising a first port and a second port, said first port and second port being configured to be differentially fed; and operatively coupling a grounding line between a virtual node of the antenna resonator element and ground, the virtual node being where current has a minimum value in the antenna resonant element when the antenna resonator element is resonant at the frequency (f).

15. The method according to claim 14, wherein the antenna resonator element comprises a first conductive portion disposed between the first and second ports, and the grounding line comprises a second conductive portion formed between a first point of the first conductive portion and the ground, and wherein the first point is disposed along the first conductive portion between the first and second ports.

16. The method according to claim 15, wherein the first point is halfway between the first and second ports of the first conductive portion.

17. The method according to claim 14, wherein the frequency (f) is within the range 700 MHz to 1000 MHz.

18. The method according to claim 17, wherein the antenna resonator element is one of a folded monopole, a folded dipole and a loop.

19. The method according to claim 17, wherein the frequency (f) is a first frequency ($f_1$) and the antenna resonator element is further configured to resonate at a second frequency ($f_2$) that is within the range 1500 MHz to 2500 MHz.

20. The method according to claim 14, wherein the antenna resonator element is a first antenna resonator element, the method further comprising:

disposing the first antenna resonator element with the operatively coupled grounding line within a portable electronic device to interface with a radio receiver therein; and disposing a second antenna resonator element within the portable electronic device to interface with a radio transmitter therein, and wherein the first and second antenna resonator elements are disposed adjacent to one another within the portable electronic device.

* * * * *

UNITED STATES PATENT AND TRADEMARK OFFICE

CERTIFICATE OF CORRECTION

PATENT NO. : 9,147,938 B2
APPLICATION NO. : 13/554058
DATED : September 29, 2015
INVENTOR(S) : Hallivuori It is certified that error appears in the above-identified patent and that said Letters Patent is hereby corrected as shown below:

In the Claims

Claim 14, col. 9, line 16 “and” should be deleted in between “(f)” and “said”.

Signed and Sealed this
Ninth Day of February, 2016

Michelle K. Lee

Michelle K. Lee
*Director of the United States Patent and Trademark Office*